US005951384A

United States Patent [19]

Morioka et al.

[11] Patent Number: 5,951,384

[45] Date of Patent: Sep. 14, 1999

[54] POLISHING APPARATUS WHICH CAUSES A POLISHING TAPE TO ADVANCE AND ROTATE

[75] Inventors: Izuru Morioka; Toru Yamazaki, both of Tokyo, Japan

[73] Assignee: Nihon Micron Coating Co., Ltd., Tokyo, Japan

[21] Appl. No.: 08/991,138

[22] Filed: Dec. 16, 1997

[30] Foreign Application Priority Data

Jul. 3, 1997 [JP] Japan ..... 9-192011

[51] Int. Cl.[6] ..... B24B 21/00

[52] U.S. Cl. ..... 451/303; 451/311; 451/168

[58] Field of Search ..... 198/837; 451/303, 451/311, 168, 169, 310; 474/110, 133

[56] References Cited

U.S. PATENT DOCUMENTS

| | | | |
|---|---|---|---|
| 3,524,284 | 8/1970 | Mears | 451/303 |
| 4,930,259 | 6/1990 | Kobulenski et al. . | |
| 5,245,792 | 9/1993 | Liechti et al. . | |
| 5,569,063 | 10/1996 | Morioka et al. | 451/296 |

FOREIGN PATENT DOCUMENTS

| | | | |
|---|---|---|---|
| 6198554 | 7/1994 | Japan | 451/296 |

*Primary Examiner*—Timothy V. Eley

*Attorney, Agent, or Firm*—Majestic, Parsons, Siebert & Hsue P.C.

[57] ABSTRACT

A polishing apparatus has a spindle disposed rotatably through an opening of a base plate, a pair of side walls attached to the spindle, a compression roller attached rotatably to an end part of and between the side walls for compressing a polishing tape onto a target object, a tape-supplying roller and a take-up roller which are both attached rotatably between and to the side walls between the spindle and the compression roller, and a tape-running roller attached rotatably between and to the side walls for causing the polishing tape to travel. The axis of rotation of the compression roller intersects that of the spindle perpendicularly and both the tape-supplying and take-up rollers are parallel to the compression roller and their axes of rotation intersect that of the spindle such that the center of gravity of the apparatus is always on the axis of rotation of the spindle. The center part of the compression roller has a smaller diameter than the end parts which sandwich it so as to prevent the polishing tape from becoming twisted or wrinkled.

7 Claims, 5 Drawing Sheets

POLISHING APPARATUS WHICH CAUSES A POLISHING TAPE TO ADVANCE AND ROTATE

BACKGROUND OF THE INVENTION

This invention relates to a polishing apparatus which uses a running and rotating tape to abrade or clean a substrate, and more particularly a flat substrate such as a liquid crystal glass substrate or a printed circuit board.

Liquid crystal products are being used in all fields of application. Liquid crystal display devices are particularly common for word processors, personal computers and television sets and are produced by carrying out various processes on glass substrates, cutting them, injecting a liquid crystal material between two of them, sealing them and attaching a polarization plate. During such a series of production processes and, in particular, when glass plates are cut, a liquid crystal material is injected or the liquid crystal is sealed in, contaminants such as glass scraps (or cullet) or residues of a resin material used for the sealing of the liquid crystal are generally generated. Such contaminants have been known to be a source of defective products.

These contaminants used to be removed by a manual labor, such as by using a paring knife or a solvent such as acetone or an alcohol. Manual removal of contaminants, however, tends to adversely affect the productivity of liquid crystal display devices and also makes it difficult to obtain products with a uniform quality level.

Electronic apparatus such as word processors and personal computers make use of printed circuit boards for attaching electronic elements such as semiconductor chips. When such circuit boards are produced, both chemical processes such as formation and removal of thin films and physical processes such as drilling and cutting are carried out in order to form circuit lines on a board. For this purpose, both surfaces of the substrate must be abraded and polished, and it has been known to make use of an endless belt, or to carry out etching, sand-blasting and buffing operations. Use of abrading tapes is becoming popular because abrading tapes can be used effectively for polishing and they can be handled easily.

U.S. Pat. No. 5,569,063 disclosed a polishing apparatus for abrading and cleaning a target object while an abrading tape is run and rotated. This apparatus has a box-shaped member attached at a lower end of a spindle adapted to rotate around its vertical axis of rotation by means of a motor such that this box-shaped member can also rotate around the axis of rotation of the spindle. A compression roller is horizontally disposed at the lower end of this box-shaped member, which also contains therein a supply roller and a take-up roller with their axes of rotation kept horizontally and parallel to each other such that an abrading tape supplied from the supply roller passes around the compression roller and is taken up by the take-up roller. The spindle and the box-shaped member are rotated by the motor while the abrading tape is supplied and taken up. Thus, the abrading tape rotates while it advances longitudinally, or "runs" and hence it can effect an abrading and polishing operation efficiently.

At the beginning of an abrading or polishing operation, the unused part of the abrading tape is mostly wound around the supply roller and the take-up roller is nearly completely empty. As the operation continues, the amount of the tape around the supply roller diminishes while the amount of the tape wound around the take-up roller increases. Thus, the center of gravity of the polishing apparatus gradually shifts from somewhere closer to the supply roller towards the take-up roller.

For effecting a smooth rotary motion, the center of gravity of the apparatus should be exactly on the axis of its rotation. In the case of the apparatus described above, however, the rotary motion is not stable because its center of gravity is near the supply roller in the beginning and gradually moves towards the take-up roller as the polishing operation continues. When the apparatus is rotated at a fast rate, in particular, the center of rotation will oscillate significantly and this may even affect the useful lifetime of the apparatus adversely.

In order to effect a smooth polishing operation, furthermore, not only should the rotary motion be smooth but it is also desirable that the running (translational) speed of the tape be constant. If the running speed is too low, this means not only that the speed of polishing is slow but the part of the tape which has been used and has hence become less effective is still being used, and this affects the efficiency of polishing adversely. If the running speed is too fast, on the other hand, although the speed of abrasion is increased and the polishing efficiency is increased because an unused part of the tape with high effectiveness is always being used but a part of the tape which has not been fully used up and hence can still contribute to the abrasion work is constantly being taken up and this amounts to a waste of a useful resource.

SUMMARY OF THE INVENTION

It is therefore an object of this invention to provide an improved polishing apparatus which can rotate stably while advancing an abrading tape.

It is another object of this invention to provide such a polishing apparatus capable of running an abrading tape at a constant speed.

A polishing apparatus embodying this invention, with which the above and other objects can be accomplished, may be characterized as having a spindle disposed rotatably through an opening of a base plate, a first rotating means attached to the base plate for causing the spindle to rotate around its axis of rotation, a pair of side walls attached to the spindle, a compression roller attached rotatably to an end part of and between the side walls for compressing a polishing tape onto a target object, a tape-supplying roller and a take-up roller which are both attached rotatably between and to the side walls between the spindle and the compression roller, a tape-running roller attached rotatably between and to the side walls for causing the polishing tape to travel, and a second rotating means for causing the tape-running roller to rotate. The axis of rotation of the compression roller intersects that of the spindle perpendicularly, and its center part has a smaller diameter than the end parts which sandwich it. The tape-supplying roller and the take-up roller are both parallel to the compression roller and their axes of rotation both intersect that of the spindle.

It is preferable that the thinner center part and the thicker end parts of the compression roller each have one-third of its total length. It is further preferable to have a table for placing the target object thereon, disposed opposite the compression roller and being movable within a plane which is perpendicular to the spindle, as well as a table-moving mechanism for causing the table to move two-dimensionally.

An auxiliary roller might also be provided, being attached to the side walls and adapted to move towards and to contact the tape-running roller to thereby make certain that the polishing tape contacts the tape-running roller.

A preferred embodiment of the invention also includes a speed-adjusting mechanism connected to the take-up roller for causing the polishing tape to be taken up by the take-up roller at a constant rate. Such an speed-adjusting mechanism may include a rotary member which is rotatably attached to the rotary shaft of the take-up roller and to which rotation of the tape-running roller is communicated, a knob member serving to rotate with the rotary shaft of the take-up roller and being movable along this rotary shaft, and an elastic member disposed between the rotary member and the knob member, such that the degree of connection between the rotary member and the knob member varies according to the degree to which the elastic member is pressed against the rotary member by the knob member.

With a polishing apparatus thus structured, the tape-supply roller and the take-up roller can be rotated stably because their centers of gravity are always on the axis of rotation of the spindle.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
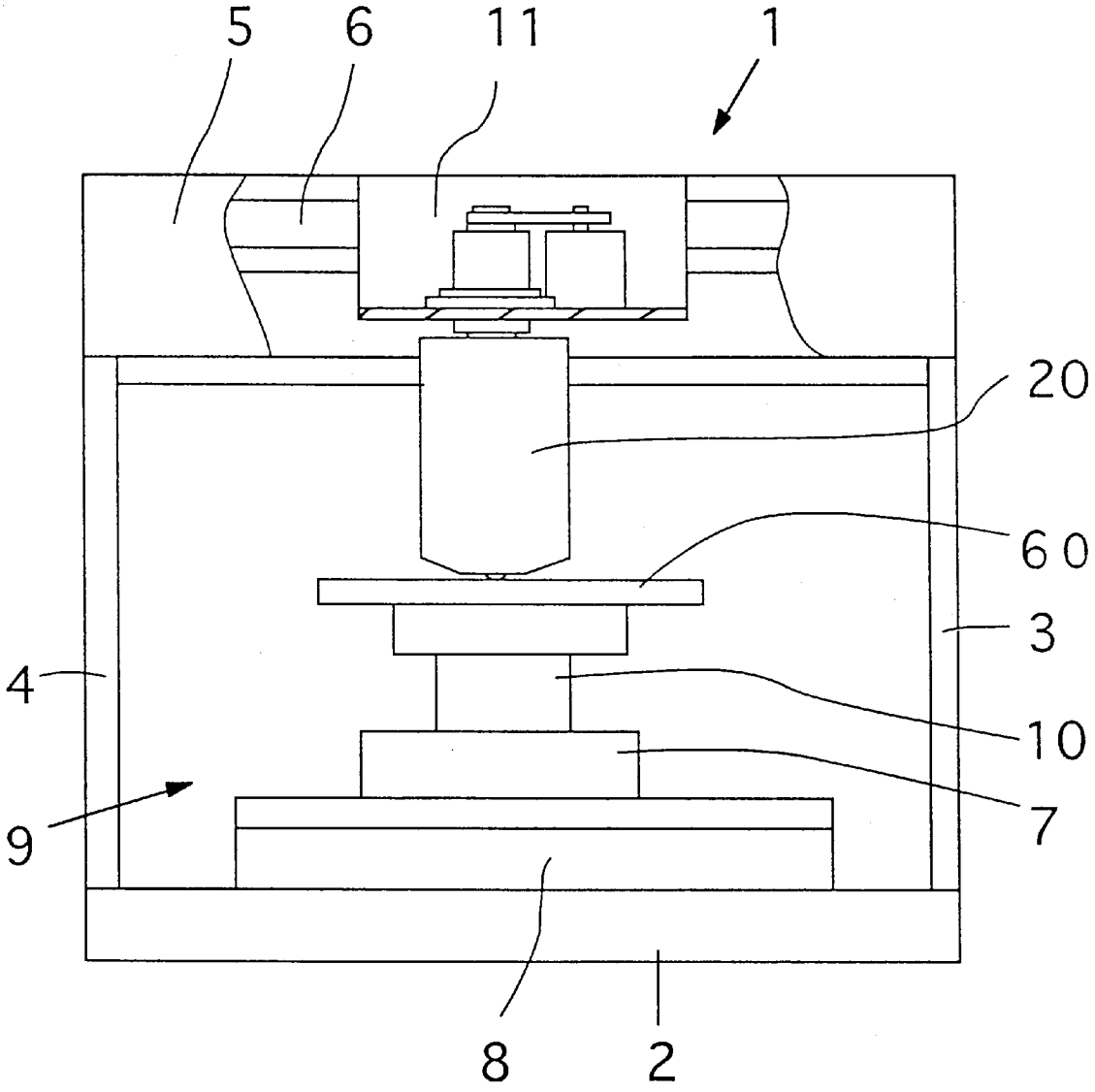
FIG. 1 is a schematic front view of a polishing apparatus embodying this invention with portions removed.

FIG. 1 shows a polishing apparatus 1 embodying this invention. Side frames 3 and 4 are perpendicularly attached to both side edges of a bottom frame 2, and horizontally extending frames 5 and 6 are attached to the front side and the back side, respectively, of the upper portions of the side frames 3 and 4. Attached to the bottom frame 2 is a horizontally moving unit 9 of a conventional kind for causing a table 60 to move two-dimensionally in a horizontal plane (defined, say, by mutually perpendicular horizontal X-axis and Y-axis (not shown)), comprising a first unit 8 and a second unit 7 for moving the table 60 parallel respectively to the X-axis and to the Y-axis. The table 60 is supported above this horizontally moving unit 9 through a lifter 10 of a known type which serves to move by mechanical means a target object, placed on top of the table 60 to be abraded or polished, selectably either towards or away from a tape-running mechanism 20 (to be described below).

Figures 2, 2A:
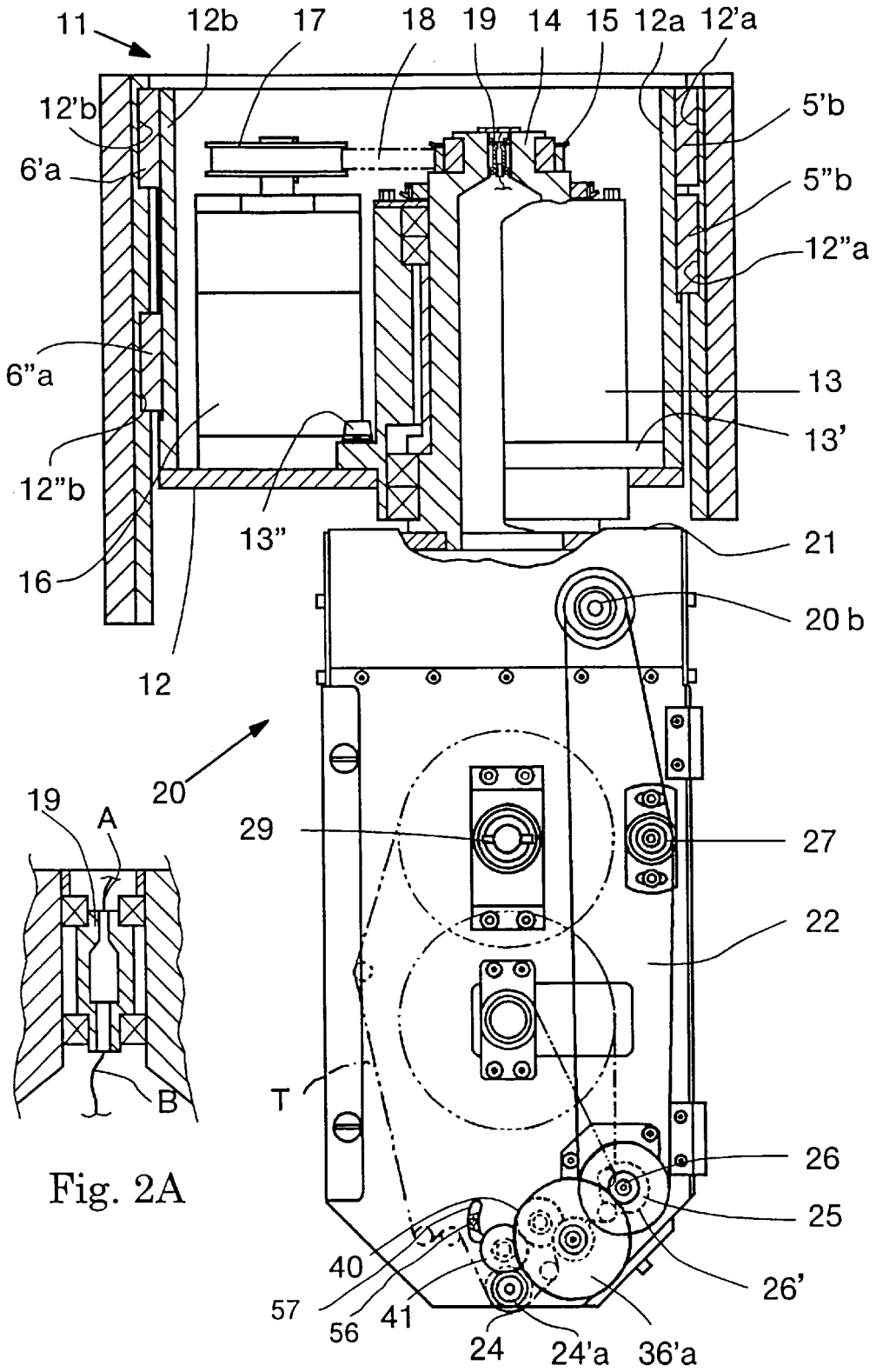
FIG. 2 is a partially sectional side view of the mobile supporting unit with portions removed and a front view of the tape-running mechanism attached to the mobile supporting unit, FIG. 2A being a portion of FIG. 2 around the connector shown enlarged.

As shown in FIG. 2 more in detail, the tape-running mechanism 20 is supported above the table 60 so as to be able to move horizontally with respect to the horizontally extending frames 5 and 6 by means of a mobile supporting unit 11.

A groove, with the size of the target object to be abraded or polished, is formed on the top surface of the table 60 and a vacuum source (not shown) is connected thereto such that the target object can be secured onto the table 60. This, however, is not an essential component of the apparatus. A stopper of any known kind may be used instead for fastening the target object on the table 60.

The manner of attachment of the mobile supporting unit 11 to the horizontally extending frames 5 and 6 is shown in detail in FIG. 2. The mobile supporting unit 11 is for supporting the tape-running mechanism 20 rotatably and comprises a base plate 12 and side walls 12*a* and 12*b* which extend perpendicularly from its front and back parts, respectively. Each of the side walls 12*a* and 12*b* is provided on its outer wall with a pair of mutually parallel grooves 12'*a* and 12"*a* or 12'*b* and 12"*b*. Slidable members 5'*b* and 5"*b* which engage respectively the grooves 12'*a* and 12"*a* are attached inside the horizontally extending frame 5, and slidable members 6'*a* and 6"*a* which engage respectively the grooves 12'*b* and 12"*b* are similarly attached inside the horizontally extending frame 6 such that the mobile supporting unit 11 can slide horizontally into and out of the paper (with respect to FIG. 2), guided by these slidable members 5'*b*, 5"*b*, 6'*a* and 6"*a*.

An opening is formed at the center of the base plate 12, allowing a hollow cylindrical member 13 having nearly the same outer diameter as that of the opening to penetrate therethrough. A flange 13' extends radially outward from a lower part of this cylindrical member 13 and contacts the upper surface of the base plate 12 so as to prevent the cylindrical member 13 from falling through the opening. The flange 13' is secured to the base plate 12 by means of screws 13".

The cylindrical member 13 has a throughhole formed therethrough along its axis, containing therein a hollow spindle 14 which is supported by bearings so as to be rotatable but prevented from slipping off. A pulley 15 is attached to the top of the spindle 14, and the tape-running mechanism 20 (to be described below) is attached to the bottom end of the spindle 14.

A motor (hereinafter referred to as the spindle-rotating motor) 16 is affixed to the base plate 12 with its drive shaft oriented perpendicularly thereto and a driver pulley 17 attached to the top end of this drive shaft. The pulley 15 attached to the spindle 14 and this driver pulley 17 are connected by means of a belt 18 such that they are in a motion-communicating relationship. In other words, as the spindle-rotating motor 16 is activated, the spindle 14 is caused to rotate inside the cylindrical member 13, and the tape-running mechanism 20 also rotates. Although the spindle 14 and its motor 16 are connected through a belt according to this embodiment of the invention, this is not intended to limit the scope of the invention. Their motion-communicating relationship may be established equally well by means of gears or similar mutually engaging means. Alternatively, the motor and the spindle may be directly connected. In the latter situation, the drive shaft of the motor and the spindle may be integrally formed.

As shown more clearly in FIG. 2A, a connector 19 is supported rotatably with respect to the spindle 14 at an upper part inside the throughhole through the hollow spindle 14. Lead lines A and B extend from both ends of the connector 19. The upper lead line A is affixed to the connector 19 but the lower lead line B is connected to the connector 19 rotatably such that the lead lines A and B are electrically connected through the connector 19.

The upper lead line A is connected to a power source (not shown), and the lower lead line B is connected to another motor (hereinafter referred to as the tape-running motor) 20*a* (shown in FIG. 4). Thus, even when the spindle-rotating motor 16 is activated to rotate the spindle 14, causing the tape-running motor 20*a* and the lower lead line B to also rotate, the connector 19 and the upper lead line A remain stationary and do not rotate with them. Since the lead lines A and B remain electrically connected, on the other hand, power can be supplied to the tape-running motor 20*a* even while it rotates with the tape-running mechanism 20. In other words, the tape-running motor 20*a* can be operated independent of the rotary motion of the spindle 14 and the tape-running mechanism 20.

Figure 3:
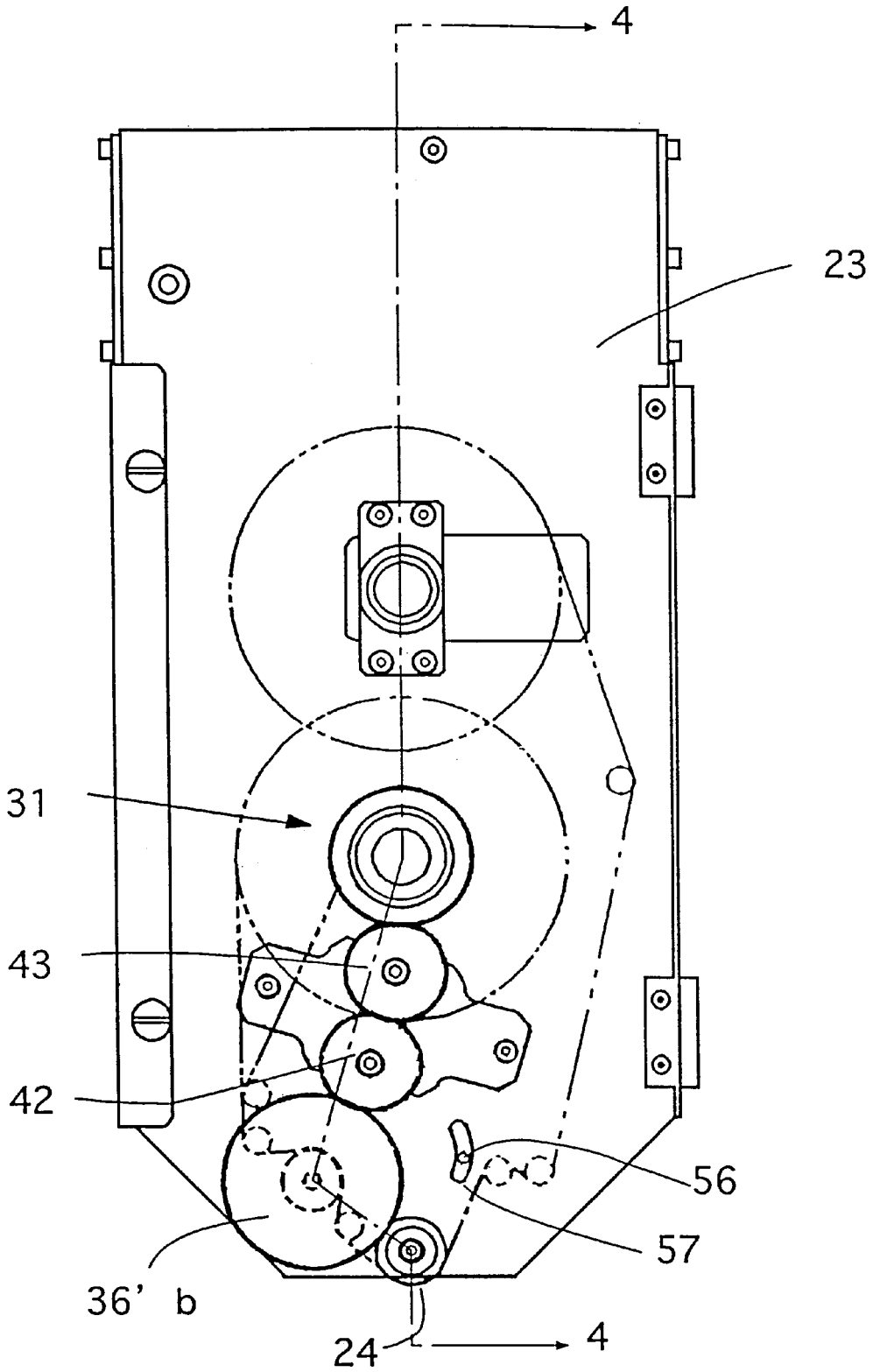
FIG. 3 is a back view of the tape-running mechanism.
Figure 4:
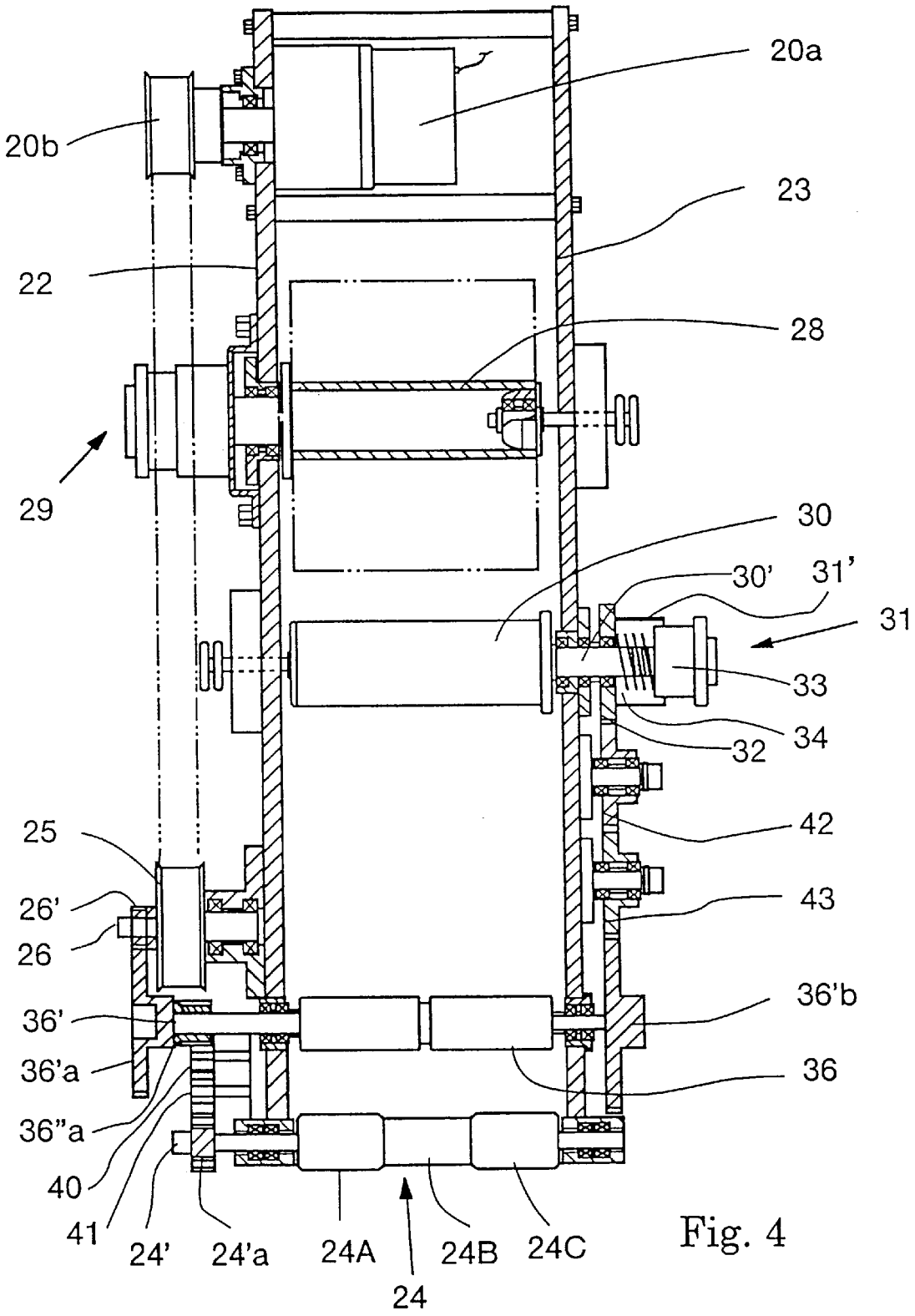
FIG. 4 is a sectional view taken along line 4—4 of FIG. 3.

As shown in FIGS. 2, 3 and 4, the tape-running mechanism 20 comprises a top wall 21 and side walls 22 and 23 which extend parallel to each other and perpendicularly from both edges of the top wall 21. The tape-running motor 20*a* is attached to an upper portion of the side wall 22 on its inside such that its drive shaft extends outward, having a driver pulley 20*b* attached to its end. The rotary shaft 26 of a follower pulley 25, which is in a motion-communicating relationship with the driver pulley 20*b* through a belt, is rotatably attached to a lower portion of the same side wall 22, and a driver gear 26' is affixed to the outer end of this rotary shaft 26.

When power is supplied to the tape-running motor 20*a*, the driver pulley 20*b* is rotated and this rotary motion is communicated through the belt to the follower pulley 25, causing the driver gear 26' to rotate also. A tension-adjusting roller 27 is provided on the outside of the side wall 22 for providing a specified tension in the belt, but this is not an essential element of this invention.

Between and at a position near the lower ends of the two side walls 22 and 23, a compression roller 24 is supported so as to be rotatable around a shaft 24' extending along a line which perpendicularly intersects the axis of rotation of the spindle 14. One end of this rotary shaft 24' extends out of the side wall 22 and supports a follower gear 24*a*.

As shown in FIG. 4, the compression roller 24 has a center part 24B and end parts 24A and 24C, each of about the same length, the end parts 24A and 24C being of the same diameter which is greater than that of the center part 24B.

A tape supply roller 28 and a take-up roller 30 are also disposed between the two side walls 22 and 23, supported thereby rotatably. The axes of rotation of these rollers 28 and 30, too, intersect the axis of rotation of the spindle 14 and are perpendicular thereto. With the axes of rotation of the rollers thus oriented, the centers of gravity of the rollers 28 and 30 remain always on the axis of rotation of the spindle 14 although the weight of the abrading tape is mostly around the supply roller 28 at the beginning and it shifts towards the take-up roller 30 as the abrasion or polishing work progresses.

The tip of the supply roller 28 extends outward from the side wall 22 and is attached to a tension-adjusting mechanism 29 for the supply roller 28. The tension-adjusting mechanism 29 is a mechanism commonly used in a polishing apparatus using a polishing tape for controlling the supply of the polishing tape (indicated by letter T in FIG. 2) such that the tape T will not become lax but will continue to have a specified tension. The tension-adjusting mechanism may comprise, for example, a spring of which the elastic force works against the rotation of the supply roller or a small motor adapted to provide a rotary motion to the supply roller in a direction opposite to that of the supply of the tape.

The tip of the shaft of take-up roller 30 extends outward from the opposite side wall 23, as shown in FIG. 4, and is attached to a speed-adjusting mechanism 31, to be described below in detail.

As shown also in FIG. 4, a tape-running roller 36 for causing the polishing tape to run at a specified speed is also provided between the two side walls 22 and 23 near the shaft 26 of the follower pulley 25. Both ends of the shaft of this tape-running roller 36 extend outward from the side walls 22 and 23. To the end which extends outward from the side wall 22 is attached a gear 36'*a* which engages with the aforementioned driver gear 26' attached to the shaft 26 of the pulley 25 connected through a belt to the tape-running motor 20*a*. To the other end is attached another gear 36'*b*. On the inner side of the gear 36'*a* is another gear 36"*a* which engages with still another gear 40. An intermediary gear 41 which engages with both the aforementioned gear 40 and the gear 24'*a* on the rotary shaft 24' of the compression roller 24 is rotatably supported by the side wall 22, as shown in FIG. 2. Thus, as the tape-running motor 20*a* is activated, the follower pulley 25 is caused through the belt to rotate, and the tape-running roller 36 is made to rotate through the driver gear 26' attached to the shaft 26 of the follower pulley 25 and the driver gear 26' which engages therewith. The rotary motion of the tape-running roller 36 depends on the diameters of the driver pulley 20*b* and the follower pulley 25, as well as the numbers of teeth of the gears 26' and 36'*a*. In other words, the rotary motion of the tape-running roller 36, that is, the translational speed of motion of the polishing tape can be adjusted by appropriately selecting these diameters and the numbers of gear teeth.

The rotary motion of the tape-running roller 36 is successively communicated to the inner gear 36"*a* on its shaft 36', the gears 40, 41 and 24'*a* and finally the compression roller 24.

The reason for using two gears 40 and 41 in this motion-communicating system is that the compression roller 24 and the tape-running roller 36 are adapted to rotate in opposite directions because the polishing tape T passes under the compression roller 36 but above the tape-running roller 36. If the tape-running roller is positioned such that the polishing tape passes therebelow, only one intermediate gear is required between the gears 36"*a* and 24' such that they will rotate in the same direction. In this situation, a belt may be used to rotate the two rollers together.

The sizes and the numbers of teeth of the gears 36"*a*, 40, 41 and 24'*a* are selected such that the speed of the polishing tape run by the compression roller 24 and that by the tape-running roller 36 will match.

The reason for causing also the compression roller 24 to rotate is that the motion of the polishing tape (inclusive of its rotary motion cause by the rotation of the spindle 14) encounters resistance when the compression roller 24 is pressed against a target object to be abraded or polished. Both the rotary and translational motions of the polishing tape can be maintained smoothly by causing also the compression roller to rotate. If the compression roller is pressed only lightly against the target object and the rotary and translational motions of the polishing tape can be maintained smoothly, there is no need to communicate the motion of the tape-running roller to the compression roller. If there is no need to keep the motion of the polishing tape at a uniform rate, furthermore, there is no need to provide the tape-running roller 36.

As shown in FIG. 4, the speed-adjusting mechanism 31 attached to the take-up roller 30 comprises a gear 32 rotatably attached to the rotary shaft 30' of the take-up roller 30 positioned inside a cover 31', a knob member 33 which engages with a screw portion formed on the rotary shaft 30' and adapted to be moved along the rotary shaft 30' , and a spring 34 disposed between the knob member 33 and the gear 32. As the knob member 33 is pushed in along the rotary shaft 30', the gear 32 and the knob member 33 become practically connected to each other against the force of the spring 34. The degree of this connection is determined by the distance by which the knob member 33 is pushed in. In other words, the farther the knob member 33 is pushed in, the stronger becomes the elastic force of the spring 34 and hence also the connection between the gear 32 and the knob member 33. If the knob member 33 is moved outward, the elastic force of the spring 34 is weakened and the connection between the gear 32 and the knob member 33 also becomes weaker.

The gear 32 is rotatably attached to the side wall 23 so as to be in a motion-communicating relationship with the gear 36'*b* attached to the tape-running roller 36 with two intermediary gears 42 and 43 therebetween. Thus, as the tape-running roller 36 is caused to rotate by the tape-running motor 20*a*, this rotary motion is communicated through the gear 36'*b* and the intermediary gears 42 and 43 to the take-up roller 30. The numbers of teeth of these gears are determined such that the take-up roller 30 will be able to smoothly wind up and take up the used-up portion of the polishing tape at the same speed as its specified traveling speed at which it is being caused by the tape-running roller 36 to reach the take-up roller 30.

As a polishing work progresses, the polishing tape is gradually wound up around the take-up roller 30, as shown in FIG. 2. Thus, although the tape-running roller 36 rotates at a constant rate and this constant rate of rotary motion is communicated through the gears to the take-up roller 30, the take-up speed of the polishing tape by the take-up roller 30 necessarily increases with time. Because the tape-running roller 36 is rotated at a constant speed, however, the rate at which the polishing tape is brought to the take-up roller 30 is also constant. Thus, rotational speed of the take-up roller 30 must be gradually diminished in order to smoothly take up the polishing tape which is brought in at a constant speed.

As described above, the take-up roller 30 is provided with the speed-adjusting mechanism 31 having the gear 32 and the knob member 33 which are connected together by the elastic force of the spring 34 such that the degree of this connection can be controlled by adjusting the depth to which the knob member 33 is pushed (or twisted) in. If this degree of connection is weakened, for example, the rotary motion of the gear 32 is not directly communicated to the knob member 33 such that a slower rotary motion can result. According to this invention, therefore, the knob member 33 is advanced only moderately such that the take-up roller 30 can rotate at a slower speed although the gear 32, together with the tape-running roller 36, rotates at a constant speed. Thus, although the take-up roller 30 is activated by the rotary motion of the tape-running roller 36 through the intermediary gears, the speed of its rotary motion can be gradually diminished such that the polishing tape being brought in at a constant speed can be smoothly taken up thereby.

As an alternative to the speed-adjusting mechanism 31 described above, a constant-torque motor (not shown) adapted to provide a constant torque to its drive shaft may be attached to the take-up roller 30. If this is done, the gears 32, 42, 43 and 36'*b* described above can be dispensed with.

If a speed-adjusting mechanism is used, as shown at 31 and described above, the rotary motion of the take-up roller 30 becomes slower gradually as the abrading or cleaning work progresses. Since a force is constantly being applied to the polishing tape in the direction of becoming wound up, this force may tend to pull the tape faster than the speed at which it is run by the tape-running roller 36 unless the adjustment of the knob member 33 is appropriate. This problem may even result in a situation where the polishing tape can no longer be run at a specified speed.

Figure 5:
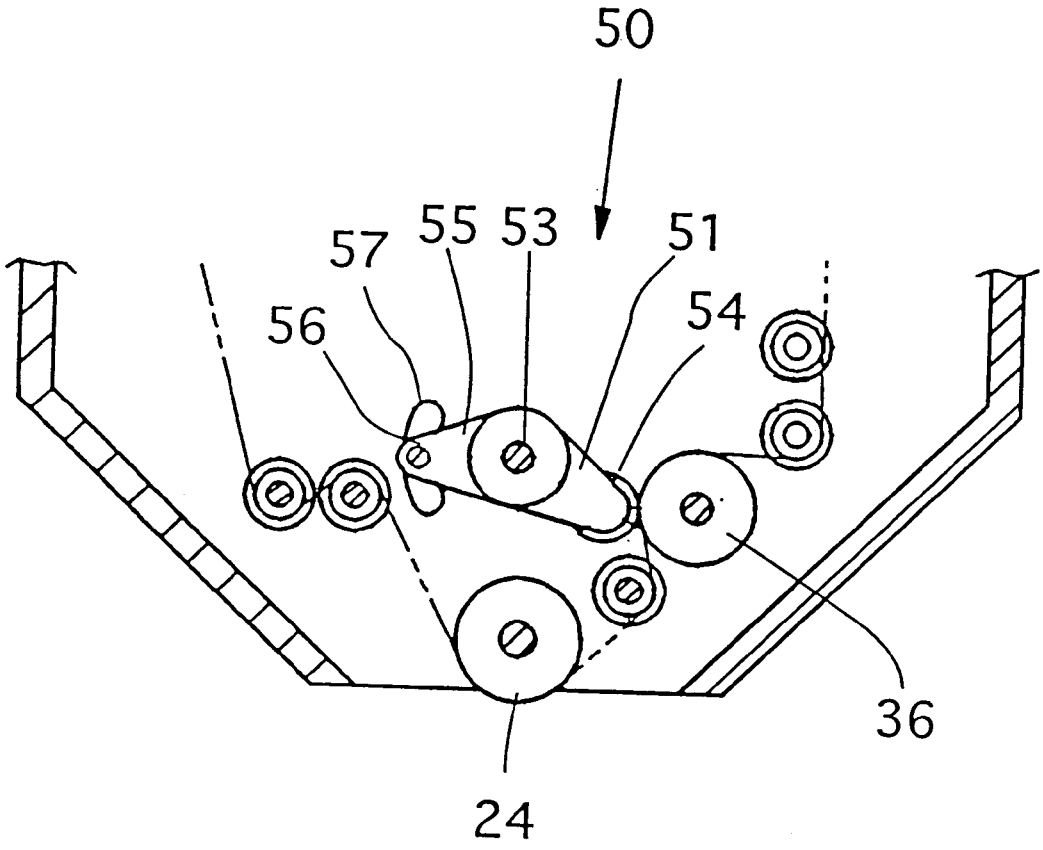
FIG. 5 is a partially sectional view of a portion of the tape-running mechanism.

FIG. 5 shows a mechanism 50 for reliably running the polishing tape at a constant speed. In the vicinity of the tape-running roller 36, a pair of elongated mutually parallel arm members 51 (only one of the pair closer to the viewer being visible in FIG. 5) is attached to a rotary shaft 53 supported rotatably between the side walls 22 and 23, and an auxiliary roller 54 which contacts the tape-running roller 36 is rotatably attached between the arm members 51. Another pair of elongated arm members 55 is attached perpendicularly to the rotary shaft 53, and a rod 56 is affixed between the tips of these arm members 55. One end of this rod 56 passes through an opening 57 which is formed in a curving elongated cross-sectional shape in the side wall 22 and protrudes outward such that the auxiliary roller 54 can be made to move towards or away from the tape-running roller 36 as this protruding end of the rod 56 is moved along the elongated opening 57. Thus, if the polishing tape is passed between the tape-running roller 36 and the auxiliary roller 54 and the rod 56 is controllingly moved inside the opening 57, the polishing tape can be pressed against the tape-running roller 36 with an appropriate pressure, and if the position of the rod 56 is thus affixed, the tape-running roller 36 is able to run the polishing tape at a desired constant speed. Thus, before an abrading or polishing work is carried out, the polishing tape T is set so as to pass from the supply roller through intermediary roller (shown by dotted lines in FIG. 2) to the compression roller 24, from there through more intermediary rollers (also shown by dotted lines in FIG. 2) to the tape-running roller 36, and finally from there to the take-up roller 30.

Although a combination of gears, pulleys and belts is used to communicate rotary motions in the example described above, this is not intended to limit the scope of the invention. Communication of rotary motion may be effected entirely by means of gears or pulley-belt systems. Neither are the positions of these motion-communicating means such as gears, pulleys and belts, as described above, intended to limit the scope of the invention, except that the center of gravity of the tape-running mechanism 20 must remain on the axis of rotation of the spindle 14 throughout the abrading or cleaning operation.

The manner of effecting an abrading or cleaning operation will be described more in detail next. First, a flat target object to be processed is placed inside an indentation (not shown) on the table 60, and a vacuum source (not shown) is activated to generate a negative pressure inside the indentation such that the target object can be secured to the table 60. Next, the mobile supporting unit 11 is activated and caused to slide in a two-dimensional plane such that the tape-running mechanism 20 is positioned appropriately. The horizontally moving unit 9 is thus operated such that the target object comes to a position directly below the tape-running mechanism 20. Thereafter, the lifter 10 is activated such that the target object is pressed against the compression roller 24 of the tape-running mechanism 20 with an appropriate pressure.

Next, the tape-running motor 20*a* is activated, causing the tape-running roller 36 to rotate through a belt and also the take-up roller 30 through the gears 36'*b*, 43, 42 and 33. As a result, an unused portion of the polishing tape is constantly supplied to the compression roller 24 to effect the abrading or cleaning operation and then wound up around the take-up roller 30.

The spindle-rotating motor 16 is also activated, thereby causing the spindle 14, and hence also the tape-running mechanism 20, to rotate. Thus, the rotary abrading or cleaning operation is effected.

As shown in FIG. 4 and explained above, the compression roller 24 has a center part 24B with a somewhat smaller diameter sandwiched between end parts 24A and 24C with a larger diameter. This is because a roller with a uniform diameter tends to twist and/or to wrinkle the tape. This is probably for the following reason.

If a roller with a uniform diameter is used to press a polishing tape against a target object and is rotated in a horizontal plane around a vertical central axis of rotation of the roller, a frictional force, which is a product of the compressive force (or its reaction) and the coefficient of friction, operates on the polishing tape in the direction opposite to the direction of rotation of the compression roller in the horizontal plane uniformly along the line of contact with the polishing tape. In the meantime, the torque with which the horizontally rotating compression roller causes the polishing tape to change its direction of motion (or to rotate) is proportional to the distance from the aforementioned vertical line. Although the compression roller rotates around its axis of rotation to advance the polishing tape, the speed of this rotation is very much smaller than the speed of rotation in the horizontal plane, and hence the effect of the longitudinal motion of the polishing tape can be ignored. Thus, the torque is larger than the force of friction at the end parts of the compression roller, and hence the corresponding portions of the polishing tape are ready to move but they more or less balance each other near the center part of the roller such that the center part of the tape is not ready to start moving. As a result, the tape will twist or wrinkle, and cannot smoothly rotate within a plane.

Because the center part 24B of the compression roller 24 is made thinner according to this invention, the polishing tape is not strongly compressed at the center region and this makes it possible to rotate the tape smoothly. The lengths of the center part 24B and the end parts 24A and 24C of the compression roller 24 are determined by the magnitudes of the torque and the friction force. The center part 24B may be relatively short when the friction force is weak, that is, when the abrasive particles on the tape are fine or when the compressive force is not strong. When the abrading force is strong, on the other hand, the center part is required to be made longer. Normally, a smooth operation is possible if each part has about one third of the total length.

It is only for the reason given above that the center part of the compression roller is made thinner according to a preferred embodiment of this invention. Thus, the center part may be totally omitted or the roller may be so designed that its diameter becomes gradually smaller towards the center.

The target surface of the target object can be uniformly abraded or cleaned by activating the horizontally moving unit 9 so as to move the table 60 in a horizontal plane. The order in which the motors 20*a* and 16 and the horizontally moving unit 9 are activated may be appropriately changed.

When the apparatus described above is used for cleaning a liquid crystal glass substrate, or when impurities are to be removed from the top of such a substrate, it is preferable to run the tape at a speed up to 150 mm/minute, to rotate the spindle at a rotary speed of up to 400 rpm and the pressure by the compression roller up to 15 kg. A polishing tape with a cushioning quality is preferred.

Many modifications and variations are possible within the scope of the invention. The disclosure is intended to be interpreted broadly, including the meaning of the words "abrading," "polishing" and "cleaning." Advantages of this invention include a stable rotary motion independent of the amount of the used portion of the tape which has been taken up, made possible because the center of gravity of the tape-running mechanism is on the axis of rotation, improved abrasion and cleaning efficiency because the polishing tape travels at a constant speed, a relatively simple structure by which the polishing tape can be advanced and rotated, reduced production cost and easier management and operation of the apparatus.

What is claimed is:

1. A polishing apparatus which causes a polishing tape to advance and to rotate, said polishing apparatus comprising:

a base plate having an opening;

a spindle disposed rotatably in said opening of said base plate;

a first rotating means attached to said base plate for causing said spindle to rotate around a first axis of rotation;

a pair of side walls attached to said spindle;

a compression roller attached rotatably to an end part of and between said side walls for compressing said polishing tape onto a target object, said compression roller being rotatable around a second axis of rotation which intersects and is perpendicular to said first axis of rotation, said compression roller having end parts and a center part which is sandwiched between said end parts, said center part having a smaller diameter than said end parts;

a tape-supplying roller and a take-up roller, which are both attached rotatably between and to said side walls between said spindle and said compression roller and are each rotatable around a rotary shaft which intersects said first axis and is parallel to said compression roller;

a tape-running roller attached rotatably between and to said side walls for causing said polishing tape to travel; and a second rotating means for causing said tape-running roller to rotate and to thereby cause said polishing tape to be supplied from said tape-supplying roller, to pass around said tape-running roller and said compression roller and to be taken up by said take-up roller.

2. The polishing apparatus of claim 1 wherein said end parts and said center part of said compression roller each have one-third of the entire length of said compression roller.

3. The polishing apparatus of claim 1 further comprising:

a table for placing said target object thereon, said table being disposed opposite said compression roller and movable within a plane which is perpendicular to said first axis of rotation; and a table-moving unit for causing said table to move in said plane.

4. The polishing apparatus of claim 2 further comprising:

a table for placing said target object thereon, said table being disposed opposite said compression roller and movable within a plane which is perpendicular to said first axis of rotation; and a table-moving unit for causing said table to move in said plane.

5. The polishing apparatus of claim 1 further comprising an auxiliary roller attached to said side walls, said auxiliary roller being capable of being moved towards and contacting said tape-running roller to thereby make certain that said polishing tape contacts said tape-running roller.

6. The polishing apparatus of claim 5 further comprising a speed-adjusting mechanism connected to said take-up roller for causing said polishing tape to be taken up by said take-up roller at a constant rate.

7. The polishing apparatus of claim 6 wherein said speed-adjusting mechanism comprises:

a rotary member rotatably attached to the rotary shaft of said take-up roller, rotation of said tape-running roller being communicated to said rotary member;

a knob member serving to rotate with the rotary shaft of said take-up roller and being movable along said rotary shaft; and an elastic member disposed between said rotary member and said knob member, said knob member serving to control connection between said rotary member and said knob member through said elastic member.

* * * * *